US005982107A

United States Patent [19]

Müessli

[11] Patent Number: 5,982,107

[45] Date of Patent: Nov. 9, 1999

[54] DRIVE CIRCUIT FOR A POWER-SAVING LAMP

[75] Inventor: Daniel Müessli, Rumisberg, Switzerland

[73] Assignee: Pinbeam AG, Saland, Switzerland

[21] Appl. No.: 08/827,919

[22] Filed: Apr. 8, 1997

[51] Int. Cl.[6] ..... H05B 37/02

[52] U.S. Cl. ..... 315/209 R; 315/307; 315/225

[58] Field of Search ..... 315/224, 225, 315/309, 307, 308, 297, 291, 209 R, DIG. 5

[56] References Cited

U.S. PATENT DOCUMENTS 5,543,690 8/1996 Bernicke et al. ..... 315/224

FOREIGN PATENT DOCUMENTS 0360156 3/1990 European Pat. Off. .
0599405 6/1994 European Pat. Off. .
3611611 10/1987 Germany .
9005992 5/1990 WIPO .

OTHER PUBLICATIONS

Laskai L. et al., "A Unity Power Factor Electronic Ballast for Metal Halide Lamps", Feb. 13, 1994, pp. 31–37.

*Primary Examiner*—Hoanganh Le
*Assistant Examiner*—Wilson Lee
*Attorney, Agent, or Firm*—Rothwell, Figg, Ernst & Kurz

[57] ABSTRACT

The object of the invention in to provide a drive circuit in which a high efficiency can be achieved and with which the voltage spikes reacting on the supply network are virtually zero. For this purpose, the discharge lamp (FL) is connected by its first electrode (E1), by means of a connecting line (VL), to the junction (H) between the emitter resistor (R3) of the first transistor (T1) and the collector of the second transistor (T2) of the high-frequency resonant circuit. The discharge lap (FL) in connected by its second electrode (E2) to the neutral conductor (0). As a result, the supply current with the superimposed control frequency flows via the load. Consequently, voltage spikes are compensated for and the efficiency in considerably increased.

10 Claims, 1 Drawing Sheet

DRIVE CIRCUIT FOR A POWER-SAVING LAMP

FIELD OF THE INVENTION

The present invention relate, in accordance with the preamble of claim 1, to a drive circuit for a power-saving lamp.

BACKGROUND OF THE INVENTION

Drive circuits for discharge lamps, also called fluorescent lamps, are known. They are described, for example, in DE-A-3611611 or in WO 90/05992. Since the first-motioned publication describes in detail the different individual parts of the arrangement, it is sufficient to provide notes in this document.

SUMMARY OF THE INVENTION

A drive circuit for a power-saving lamp is presently disclosed having a rectifier arrangement on the AC mains with a phase conductor and neutral conductor having an oscillation build-up circuit and having a high-frequency resonant circuit. The circuit has a third inductance which is wound together with the oscillation build-up circuit and the high-frequency resonant circuit onto a common core, forming a current transformer.

DETAILED DESCRIPTION

Figure 1:
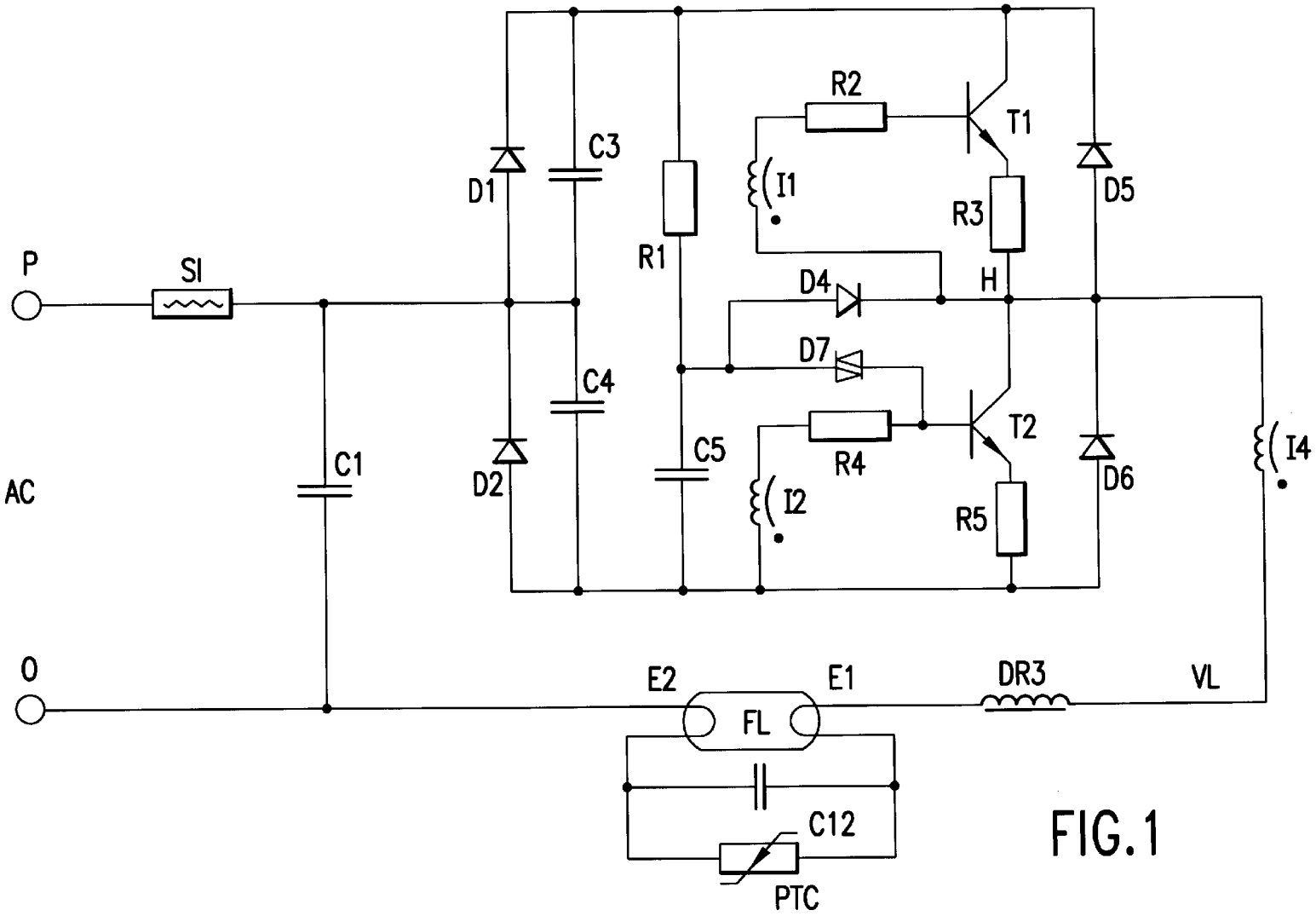
FIG. 1 is a schematic drawing of a drive circuit for a power-saving lamp.

A main component is a push-pull frequency generator with the two transistors T1 and T2 and the freswheeling diodes D5 and D6 which, together with the resistor R1 and the capacitor C5, stabilize the frequency of the high-frequency resonant circuit. In this case, the capacitor influence the rise characteristic of the transistors T1 and T2. For their operation, the transistors are additionally provided with base resistors R2, R4 and with the emitter resistors R3, R5. The coupling capacitors C3, C4 are used to define the rising edge of the rectifier with the diodes D1, D2. An oscillation build-up circuit comprises a first resistor R1 and a capacitor C5, a diode D4 and a diac, D7 and ensures that the high-frequency resonant circuit with a first inductance I1 on the base resistor R2 and with a second inductance I2 on the bass resistor R4 is made to oscillate when the mains voltage AC across the terminals P and O is turned on. The two windings I1 and I2 are wound onto a common annular core.

The problem to be solved is, on the one hand, to increase the efficiency of the discharge lamp, which is fixed worldwide by the electricity companies least 95%, and to prevent interfering voltage spikes on the mains voltage as a result of the high frequency.

In order to avoid the voltage spikes, the solution described in accordance with DE-A 3611611 uses inductors in the mains frequency range, which are relatively large and heavy and are not strictly suitable for power-saving lamps. The drive circuit in accordance with the abovementioned WO-90/05992 relates to a temperature compensation for keeping the luminous efficiency of the discharge lamps constant, but the driving is effected by an arrangement similar to that described.

Accordingly, it is an object of the invention to provide a drive circuit in which a high efficiency can be achieved and the voltage spike reacting on the supply network are virtually zero.

According to the invention, this is achieved by means of the features in the defining part of claim 1 in that the discharge lamp is connected by its first electrode, by means of a connecting line, to the junction between the emitter resistor of the first transistor and the collector of the second transistor of the high-frequency resonant circuit, and in connected by its second electrode to the neutral conductor.

An exemplary embodiment of the invention is explained in more detail below with reference to the single FIGURE in the drawing.

The arrangement explained in the introduction relates to this single figure with the corresponding reference symbols. Consequently, only the additional connection path VL and its effect have to be described at this point.

The connecting line VL connects the common connection H of the two transistor T1 and T2 and leads via an inductance I4 which is wound together with the abovementioned inductances I1 and I2 onto a common annular core, and an inductor DR3 to the first electrode E1 of the discharge lamp FL.

The second electrode E2 of the discharge lamp FL is connected to the neutral conductor O of the supply network, with the result that the entire current flow from the supply is always paused via the discharge lamp FL. Consequently the supply voltage 50 Hz and the control frequency of 40 kHz flow via the discharges lamp FL, resulting in current limiting. The rectification by the diodes D5 and D6 clips the overvoltage spikes which are generated by the transistors T1 and T2 together with the inductance of the inductor DR3. The capacitors C3 and C4 transmit the high frequency and at the some time store the energy from the mains voltage rectification by the diodes D1 and D2. The capacitor C1 on the input side is necessary for the feedback of the high frequency.

As a result, the supply voltage for the high-frequency resonant circuit is passed via the load and the connecting line, and this results in all of the losses passing via said load.

I claim:

1. A drive circuit for a power saving lamp comprising:

an AC mains with a phase conductor and a neutral conductor;

an oscillation build-up circuit coupled to said AC mains;

a high-frequency resonant circuit coupled to said oscillation build-up circuit; and a discharge lamp having a first electrode coupled to said high-frequency resonant circuit and a second electrode directly connected to said AC mains, wherein the second electrode bears the full load of the supply voltage of the high-frequency resonant circuit.

2. A drive circuit for a power saving lamp comprising:

an AC mains with a phase conductor and a neutral conductor;

an oscillation build-up circuit connected to said AC mains;

a high-frequency resonant circuit connected to said oscillation build-up circuit;

at least one inductance wound together with said high-frequency resonant circuit and connected in series to said high-frequency resonant circuit;

a discharge lamp having a first electrode connected to said inductance and a second electrode connected directly to said neutral conductor.

3. The drive circuit of claim 1 wherein the high-frequency resonant circuit comprises:

a discharge lamp having a first inductance connected to a first resistance;

a second resistance connected to a second inductance;

a first transistor with an emitter and a collector connected to said first resistance;

a second transistor with an emitter and a collector connected to said second resistance;

a third resistance connected to the emitter of the first transistor;

a fourth resistance connected to the emitter of the second transistor;

a first free-wheeling diode connected between the collector of the first transistor and the third resistance; and a second free-wheeling diode connected between the collector of the second transistor and the fourth resistance.

4. The drive circuit of claim 2 wherein the high-frequency resonant circuit comprises:

a first inductance connected to a first resistance;

a second resistance connected to a second inductance;

a first transistor with an emitter and a collector connected to said first resistance;

a second transistor with an emitter and a collector connected to said second resistance;

a third resistance connected to the emitter of the first transistor;

a fourth resistance connected to the emitter of the second transistor;

a first free-wheeling diode connected between the collector of the first transistor and the third resistance; and a second free-wheeling diode connected between the collector of the second Transistor and the fourth resistance.

5. The drive circuit of claim 1, wherein the oscillation build-up circuit comprises:

a capacitor and resistor connected between said high-frequency resonant circuit and said AC mains such that the capacitor and resistor are connected in parallel;

a diode connected between a junction of said capacitor and resistor and said high-frequency resonant circuit; and a diac connected between a junction of said capacitor and resistor and said high-frequency resonant circuit.

6. The drive circuit of claim 2, wherein the oscillation build-up circuit comprises:

a capacitor and resistor connected between said high-frequency resonant circuit and said AC mains such that the capacitor and resistor are connected in parallel;

a diode connected between a junction of said capacitor and resistor and said high-frequency resonant circuit; and a diac connected between a junction of said capacitor and resistor and said high-frequency resonant circuit.

7. A drive circuit for a power saving lamp comprising:

an input means for supplying voltage to the circuit having a phase conductor and a neutral conductor;

a discharge lamp having first and second electrodes, for providing a source of light, said second electrode being connected directly to said neutral conductor;

a resonating means for generating high frequency current;

an inductance means connected to said first electrode for providing current flow to said discharge lamp, connected between said discharge lamp and said resonating means;

a rectifying means for clipping an over-voltage spike generated by said resonating means and said inductance means, connected to said phase conductor and said resonating means; and an oscillation means for causing output from said resonating means to oscillate when voltage is applied to said drive circuit, connected between said resonating means and said rectifying means.

8. The drive circuit of claim 1, further comprising a temperature-controlled PTC resistor connected in parallel to said discharge lamp, such that full current flow is directed to said high-frequency resonant circuit until said discharge lamp has reached a predetermined temperature.

9. The drive circuit of claim 2, further comprising a temperature-controlled PTC resistor connected in parallel to said discharge lamp, such that full current flow is directed to said high-frequency resonant circuit until said discharge lamp has reached a predetermined temperature.

10. The drive circuit of claim 7, further comprising a temperature-controlled PTC resistor connected in parallel to said discharge lamp, such that full current flow is directed to said high-frequency resonant circuit until said discharge lamp has reached a predetermined temperature.

* * * * *